US008820236B2

(12) United States Patent
Beier et al.

(10) Patent No.: US 8,820,236 B2
(45) Date of Patent: Sep. 2, 2014

(54) DEVICE FOR SUPPLYING RADIANT ENERGY ONTO A PRINTING SUBSTRATE

(75) Inventors: Bernard Beier, Ladenburg (DE); Uwe Ernst, Mannheim (DE); Heiner Pitz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1405 days.

(21) Appl. No.: 11/114,282

(22) Filed: Apr. 26, 2005

(65) Prior Publication Data

US 2005/0235851 A1 Oct. 27, 2005

(30) Foreign Application Priority Data

Apr. 27, 2004 (DE) ..... 10 2004 020 454

(51) Int. Cl.
*B41F 23/04* (2006.01)

(52) U.S. Cl.
USPC ..... 101/424.1; 101/484; 101/487; 101/488; 34/273; 34/653; 34/620

(58) Field of Classification Search
USPC ..... 101/424.1, 488, 484, 487; 34/273, 620, 34/653
See application file for complete search history.

(56) References Cited

U.S. PATENT DOCUMENTS

| | | | | |
|---|---|---|---|---|
| 5,115,741 | A | 5/1992 | Rodi | 101/424.1 |
| 5,536,921 | A | 7/1996 | Hedrick et al. | 219/693 |
| 5,558,666 | A * | 9/1996 | Dewey et al. | 606/9 |
| 5,768,017 | A * | 6/1998 | King et al. | 359/559 |
| 6,026,748 | A | 2/2000 | Reed et al. | 101/424.1 |
| 6,066,830 | A * | 5/2000 | Cline et al. | 219/121.69 |
| 6,350,071 | B1 * | 2/2002 | Conwell et al. | 400/118.2 |
| 6,393,042 | B1 * | 5/2002 | Tanaka | 372/101 |
| 6,401,358 | B1 * | 6/2002 | Bar et al. | 34/266 |
| 6,777,170 | B1 * | 8/2004 | Bloomstein et al. | 430/320 |
| 6,832,552 | B2 * | 12/2004 | Patten et al. | 101/463.1 |
| 6,852,948 | B1 * | 2/2005 | Harrison | 219/121.85 |
| 6,857,368 | B2 * | 2/2005 | Pitz | 101/484 |
| 7,271,950 | B1 * | 9/2007 | Gordon et al. | 359/359 |
| 2002/0062755 | A1 * | 5/2002 | Suda et al. | 101/488 |
| 2003/0007535 | A1 * | 1/2003 | Haase et al. | 372/50 |
| 2003/0013034 | A1 | 1/2003 | Behnke et al. | 430/124 |
| 2003/0075063 | A1 | 4/2003 | Pitz | 101/424.1 |
| 2003/0214571 | A1 * | 11/2003 | Ishikawa et al. | 347/255 |
| 2004/0011234 | A1 * | 1/2004 | Figov et al. | 101/488 |
| 2004/0200370 | A1 | 10/2004 | Pitz et al. | 101/483 |
| 2004/0206260 | A1 | 10/2004 | Pitz | 101/424.1 |

FOREIGN PATENT DOCUMENTS

| | | |
|---|---|---|
| DE | 44 35 077 | 11/1995 |
| DE | 101 45 005 | 7/2002 |
| DE | 102 34 076 | 4/2003 |

(Continued)

*Primary Examiner* — Judy Nguyen
*Assistant Examiner* — Jennifer Simmons
(74) *Attorney, Agent, or Firm* — Davidson, Davidson & Kappel, LLC

(57) ABSTRACT

A device for supplying radiant energy onto a printing substrate (14), including at least one radiant energy source (10) whose light (12) impinges on the printing substrate (14) on the path (16) of the printing substrate (14) through a printing press at a position (116) downstream of at least one printing nip (18) in a printing unit. The radiant energy source (10) emits light (12) having a peak-to-valley homogeneity of less than 15% in a direction transverse to the direction of the path (16) of the printing substrate (14).

16 Claims, 3 Drawing Sheets

(56) References Cited

FOREIGN PATENT DOCUMENTS

| | | |
|---|---|---|
| DE | 103 16 471 | 10/2004 |
| DE | 103 16 472 | 10/2004 |
| EP | 03 55 473 | 10/1993 |
| EP | 0 378 826 | 4/1996 |
| EP | 1 279 497 | 1/2003 |
| JP | 2003-326674 | 11/2003 |

* cited by examiner

DEVICE FOR SUPPLYING RADIANT ENERGY ONTO A PRINTING SUBSTRATE

This application claims priority to German Patent Application DE 10 2004 020 454.3, filed Apr. 27, 2005, the entire disclosure of which is incorporated by reference herein.

BACKGROUND

The present invention relates to a device for supplying radiant energy onto a printing substrate comprising at least one radiant energy source whose light impinges on the printing substrate on the path of the printing substrate through a printing press at a position downstream of at least one printing nip in a printing unit.

Depending on the type of printing ink and the underlying particular drying process, printing machines, in particular, planographic printing presses such as lithographic printing presses, rotary printing presses, offset printing presses and the like, which process sheet or web stock, in particular, paper, cardboard, carton and the like, are known to have different devices which initiate or promote adhesion of the ink to the printing substrate by supplying radiant energy to the printing ink present on the substrate.

The so-called "UV inks" cure by polymerization, which is triggered by photoinitiation using ultraviolet light. On the other hand, solvent-containing printing inks, which are able to undergo both a physical as well as a chemical drying process, are very common. The physical drying includes the evaporation of solvents and the diffusion into the printing substrate (absorption), whereas "chemical drying" or "oxidative drying" are understood to mean drying due to the polymerization of the oils, resins, binding agents or the like included in the ink formulations, possibly with the participation of atmospheric oxygen. Generally, the drying processes are dependent on each other since, because of the absorption of the solvents, a separation between solvents and resins occurs within the binder system, as a result of which the resin molecules can get close to one another and, possibly, be polymerized more easily.

It is already known to subject printed products to a drying process after the printing process to allow the printed products to be further processed without delay. At this point, mention should be made, for example, of UV inks in conjunction with UV driers, heatset inks in conjunction with hot-air dryers or IR dryers.

However, UV inks are considered critical to health and need to be disposed of separately. Moreover, the UV radiation creates ozone, resulting in the requirement for expensive exhaust equipment or inerting procedures.

In contrast, heatset drying requires a large amount of energy and may lead to excessive drying of the printing substrate and, thus, to unwanted warping.

The use of spectrally broadband IR dryers can also lead to excessive drying and, thus, to unwanted warping of the printing substrate, because the larger portion of the energy is absorbed by the printing substrate while only a small portion is absorbed by the actual printing ink to be dried.

Moreover, the use of drying accelerators, so-called "siccatives", in the printing ink can easily lead to premature drying of the printing ink and, thus, to build-up of printing ink on the surfaces of the printing unit cylinders. Therefore, the dosage of siccatives is limited.

German Patent Application No. 102 34 076 A1, for example, describes a device for drying printing ink on printing substrates, including a radiant energy source, in particular a laser, which emits light in the near infrared region. The wavelength of this IR radiation is selected to be non-resonant to absorption wavelengths of water, which makes it possible to heat only the ink but not the sheet.

Moreover, for example, German Patent Application No. 103 16 471 describes a method for drying a printing ink on a printing substrate, in which the printing substrate is exposed to laser radiation whose wavelength is between 350 nm and 700 nm, and is substantially resonant to an absorption wavelength of at least one color pigment of the printing ink. Besides the pigment, no other absorbing agent is needed for the radiation.

Furthermore, for example, German Patent Application No. 103 16 472 discloses a method for drying a printing ink on a printing substrate, in which, in addition to the printing ink, a primer or coating is applied to the printing substrate; the primer or coating being suitable to accelerate the drying of the printing ink by absorption of radiation.

European Patent Application No. 0 355 473 A2, for example, describes a device for drying printed products, which includes a radiant energy source in the form of a laser. The radiant energy is transmitted to the surface of the printing substrates, which are conveyed along a path through the printing press by a transport device, at a position between individual printing units or following the last printing unit, before or in the delivery. In this context, the radiation source can be a laser in the ultraviolet for UV inks or a laser in the infrared for heating solvent-containing printing inks. The radiant energy source is located outside the printing press to prevent parts of the press from being undersirably heated because of dissipation heat that cannot be avoided or shielded. Here, the disadvantage is, however, that an additional system component must be separately provided to the user of the printing press.

Moreover, it is known, for example, from U.S. Pat. No. 6,026,748 that a printing press can be provided with a dryer system featuring infrared lamps which emit short-wave infrared light (near infrared) or medium-wave infrared light. Lamp light sources have a wide-band emission spectrum, offering a multitude of wavelengths. The drawback of such drying devices in the infrared region is that a considerable proportion of the energy absorption takes place in the paper, the ink only being indirectly heated. A rapid drying is only possible by inputting enough energy. In the process, however, there is the danger, inter alia, of the printing substrate drying out unevenly and becoming warped.

In electrophotographic printing, it is known, for example, from German Patent Application No. DE 44 35 077 A1, to fix toner on a recording medium using radiant energy in the near infrared region emitted by diode lasers. A narrow-band light source is used to heat the toner particles, in order to melt them, to form them into a colored coating, and to anchor them to the surface of the recording medium. Since a great number of common paper types have broad absorption minima in this spectral range, it is possible for a predominant part of the energy to be directly absorbed in the toner particles.

However, the simple knowledge of the window in the paper's absorption spectrum cannot be directly exploited in printing technology that uses solvent-containing printing inks, since, as described above, there are other underlying chemical and/or physical drying processes.

SUMMARY OF THE INVENTION

In the context of the present invention, the concept of solvent-containing printing ink connotes, in particular, inks whose solvent constituents may be of an aqueous or organic nature, which are based on binding agent systems, which are able to be oxidatively, ionically or radically polymerized. An energy input for drying solvent-containing printing inks is intended to assist or promote the effect of evaporation of the solvent and/or the effect of absorption into the printing substrate and/or the effect of polymerization, unwanted secondary effects, such as excessive heating of the solvent-containing printing ink, which can lead to a breakdown of components, or overheating of the solvent, being avoided at the same time. It is not intended for the energy input to be introduced just for melting particles, as in the case of fixing the toner.

A problem that can arise in prior art devices is that the dried product shows visible traces of the drying process. These traces may be visible, for example, as longitudinal or transverse streaks in the product, and may impair the quality of the finished product.

An object of the present invention is to provide an improved device for supplying radiant energy onto a printing substrate, which allows the drying process to be carried out without producing unwanted visible changes in the printed product.

An inventive device for supplying radiant energy onto a printing substrate, including at least one radiant energy source whose light impinges on the printing substrate on the path of the printing substrate through a printing press at a position downstream of at least one printing nip in a printing unit is characterized in that the radiant energy source emits light having a peak-to-valley homogeneity of less than 15% in a direction transverse to the direction of the path of the printing substrate.

In accordance with the present invention, the level of homogeneity of light of the radiant energy source achieved, for example, by the homogenizing optical system, has a value of less than 15%, and more preferably a value of less than 10% or 5%; the percentages referring to the difference between a lowest and a highest value in the lateral intensity of light 12 (peak-to-valley homogeneity).

In connection with the present invention, it was found that when the homogeneity of the radiation in the transverse direction is provided to have a peak-to-valley variation of less than 15%, the formation of longitudinal streaks can be effectively prevented.

In an embodiment of the present invention which is optimized in terms of the accuracy of the irradiation dose, the position at which the light impinges on the printing substrate in the path through the planographic printing press is selected such that at this position, the printing substrate essentially does not move in the propagation direction of the radiation. Within a depth of focus of the optical system of about 3 mm (but at least of 1 mm), the power density should not vary more than 15% and/or the focus size should not change more than 15%, preferably not more than 10% or 5%.

In connection with the present invention, it was discovered that when the position of the radiant energy source and thus the point of incidence of the light are selected to be at a specific position where the printing substrate is transported in a stable and flutter-free manner, the formation of transverse streaks in the product can be effectively prevented.

The position may preferably be selected to be close to an impression cylinder or close to a reversing drum or close to a transfer cylinder.

Furthermore, it may be preferred for the radiant energy source to be positioned in the area of a substrate transport device without gripper bars, such as a (suction) belt conveyor device, (preferably in a delivery or at a position downstream of at least one printing unit), because the absence of gripper bars allows positioning at a small distance from the printing substrate or the path of the printing substrate, and therefore less / no disturbances by moving gripper bars are to be expected.

The inventive device for supplying radiant energy may also be characterized in that the radiant energy source essentially emits only light whose wavelength is non-resonant to absorption wavelengths of water ($H_2O$).

In the context of the present invention, "non-resonant to absorption wavelengths of water" is understood to mean that the absorption of the light energy by water at 20° Celsius is no greater than 10.0%, in a preferred embodiment no greater than 1.0%, in particular, below 0.1%. In this connection, the radiant energy source emits only a very low intensity of light, preferably no light at all, that is resonant to absorption wavelengths of water ($H_2O$).

In an advantageous embodiment, the radiant energy source is narrow-band. In this context, the radiant light source can emit, for example, in a range of up to ±50 nm around a wavelength; one or more separate, spectroscopically narrow emission lines being possible as well.

In addition, in one advantageous embodiment, the emission maximum of the narrow-band radiant energy source or the wavelength of the radiant energy is between 700.00 nm and 3000.00 nm, preferably between 700.00 nm and 2500.00 mn, in particular between 800.00 nm and 1300.00 nm, in one partial region of the so-called "window" in the paper absorption spectrum. Of particular advantage is an emission at 870.00 nm±50.00 nm and/or 1050.00 nm±50.00 nm and/or 1250.00 nm±50.00 nm and/or 1600.00 nm ±50.00 nm. Moreover, suitable wavelengths among the diode laser wavelengths available are 808 nm, 860 nm, 880 nm, 940 nm, 980 nm (in each case ±10 nm).

Here, the underlying realization is that absorption bands of water contribute to the absorption spectrum of paper. The typical water content of printing substrates in waterless (damping solution-free) planographic printing inherently leads to undesired, often even unacceptably strong energy absorption in the printing substrate. This absorption is even more pronounced in planographic printing where damping solutions are used. Too great of an energy input into the printing substrate may therefore be avoided by the radiation of one wavelength that is not resonant to an absorption line or absorption band (absorption wavelength) of water. n accordance with the HITRAN database, at a temperature of 296 K, in 1 m absorption path, and given 15000 ppm of water, the following absorption by water, more precisely by water vapor results: at 808 nm smaller than 0.5%, at 870±10 nm smaller than 0.01%, at 940±10 nm smaller than 10%, at 980±10 nm smaller than 0.5%, at 1030±30 nm smaller than 0.01%, at 1064 nm smaller than 0.01 %, at 1100 nm smaller than 0.5% and at 1250±10 nm smaller than 0.01%. When looking at a surface of the printing substrate, in particular, of the paper, of 1 $m^2$ and an air path of 1 m thereabove, then the air contains an amount of water of about 12 g at an absolute humidity of 1.5%. As long as in one embodiment of the device according to the present invention, the light source is no further than 1 m away from the printing substrate, and the absolute humidity is not clearly higher than 1.5%, the above-indicated absorptions by water and/or water vapor are not exceeded. There may be an additional absorption by the moisture content of the printing substrate in the case that the light penetrates through the ink film into the printing substrate, or by damping solutions that have been transferred by the printing process to the sheet.

The printing ink can absorb different wavelengths, depending on the functional groups of the individual components in the printing ink, in particular, of the pigment, of the coloring matter or coloring agent, of the binding agent (varnish), of the solvent, of the oil or resin, of the extender, of the auxiliary, of the additives or admixtures or the like. Using the device according to the present invention, light in the near infrared is provided to the printing ink present on the printing substrate in the planographic printing press, while avoiding absorption wavelengths of water, for example, by radiating only a small number of wavelengths of a light source which emits a line spectrum.

Moreover, the printing ink can contain an infrared-absorbing agent. Coupling of the light into the printing ink and/or absorption of the radiant energy in the printing ink is carried out, rendered possible, promoted, improved, or facilitated by the infrared-absorbing agent. In the context of this description of the present invention, to simplify the language, one only speaks of assisting, and this is intended to mean all gradations in the action of the infrared-absorbing agent. The energy input, which may result in the generation of heat, accelerates the drying of the printing ink. On the one hand, a high temperature may be briefly produced in the printing ink (in the ink film) on the printing substrate, on the other hand, chemical reactions may be excited or initiated in some instances as a function of the composition of the printing ink. The infrared-absorbing agent, also referred to as infrared absorber, IR absorber, IR absorbing substance or the like, can, on one hand, be a component in the printing ink that has a functional group which absorbs in the near infrared or, on the other hand, it can be an additive or an admixture which is added or admixed to the printing ink prior to printing. In other words, the printing ink can be supplemented with an infrared-absorbing agent or include a component which is modified to an infrared-absorbing agent. In this context, the infrared-absorbing agent preferably has the property of having only little or even no absorption in the visible range of wavelengths in order for the color appearance of the printing ink to be influenced or changed only slightly or even not at all.

It is advantageously possible to attain a relatively high input of energy directly into the printing ink, in particular assisted by an infrared-absorbing agent, without any unwanted energy input into the printing substrate. This is due to the fact that, on the one hand, the light cannot be absorbed directly by the printing substrate and, on the other hand, the energy absorbed by the ink film is distributed after fractions of seconds to the ink and printing substrate. The heat-absorption capacity and the quantitative proportions are distributed here in such a way that the ink film is able to be briefly heated, before the entire printed sheet undergoes a homogeneous, moderate temperature increase. This reduces the total required energy input. The selective energy input may be assisted in particular by radiating a wavelength that is resonant or quasi-resonant to absorption lines of a component of the printing ink or to an absorption line or an absorption maximum of an infrared-absorbing agent in the printing ink. The radiant energy is absorbed in the printing ink at a rate of more than 30%, preferably 50%, in particular 75%, and even at a rate of more than 90%.

Moreover, by avoiding the absorption of energy in water, the drying of the printing substrate is reduced. This is advantageous since, inter alia, the format of a printing substrate is altered when it is dried. Because of the so-called "swelling process", the format of the printing substrate varies as a function of its drying state or of its moisture content. The swelling process between individual printing units necessitates different printing form formats in the individual printing units. A change in the moisture content between the printing units due to the influence of a radiation-induced drying, resulting in deviations that are only able to be determined in advance and corrected with substantial outlay, is avoided when the device of the present invention is used to dry the printing ink.

In other words, the device according to the present invention allows the solvent-containing printing ink to dry on the printing substrate without influencing too much the drying of the printing substrate.

The radiant energy source may preferably include at least one laser, which may be a semiconductor laser or a solid-state laser.

To achieve the most narrow-band emission possible, at the same time maintaining a high spectral power density, the radiant energy source is preferably a laser. Alternatively, it is also possible to use a broadband light source, such as a carbon IR emitter, with a suitable filter system so that, in combination, a narrow-band radiant energy source is created. One filter can be, in particular, an interference filter. For spatial integration within the planographic printing press, it is preferred for the laser to be a semiconductor laser (diode laser) or a solid-state laser (titanium-sapphire laser, erbium-glass, NdYAG, Nd-glass or the like). A solid-state laser may preferably be optically pumped by doide lasers. The solid-state laser may also be a fiber laser or optical fiber laser, preferably a ytterbium fiber laser, which is able to supply 300 to 700 W optical power at the work station at 1070 nm to 1100 nm. Lasers of this kind may also be advantageously tunable within certain limits. In other words, the output wavelength of the lasers is variable. As a result, it is possible to tune to a desired wavelength, for example resonantly or quasi-resonantly to an absorption wavelength of a component in the printing ink, in particular to an infrared-absorbing agent in the printing ink.

The device may preferably include a plurality of radiant energy sources which are arranged in a one-dimensional array, in a two-dimensional array, or in a three-dimensional array, and whose light impinges on the printing substrate at a number of positions, it being possible to use lasers, in particular semiconductor lasers or solid-state lasers, here as well.

By using a number of individual radiant energy sources for individual regions on the printing substrate, the maximum required output power of the radiant energy sources is reduced. Light sources of lower output power are generally more cost-effective and have a longer life expectancy. Moreover, unnecessarily high dissipation heat is prevented. The energy input per area through the supply of radiant energy is between 100 and 10.000 mJ/cm$^2$, preferably between 100 and 1000 mJ/cm$^2$, in particular between 200 and 500 mJ/cm$^2$. The printing substrate is irradiated for a period of time between 0.01 ms and I s, preferably between 0.1 ms and 100 ms, in particular between 1 ms and 10 ms. In a preferred embodiment, the input of radiant energy during the specified periods of time can be accomplished using a line focus of the radiation; the printed sheet or the substrate being passed thereunder. The interaction time is obtained as a function of the dimension of the line focus in the moving direction of the substrate and the speed thereof [m/s]. Additional knowledge of the irradiance [W/cm$^2$] yields the irradiation of the substrates [mJ/cm$^2$].

In a further embodiment of the present invention, the light incident on the printing substrate at one position may be controllable in its intensity and exposure time for each radiant energy source independently of the other radiant energy sources.

For this purpose, a control unit may be provided that is independent from or integrated in the machine control of the planographic printing press. By controlling the parameters of the radiant energy source, it is possible to regulate the energy input at different positions of the printing substrate. Energy input may then be adapted to the coverage of the printing substrate at the position in question on the printing substrate. Moreover, it is also advantageous to set up the device of the present invention with a plurality of radiant energy sources in such a manner that light from at least two radiant energy sources impinges at one position on the printing substrate. On the one hand, this may be a question of partially overlapping light beams, and, on the other hand, of completely overlapping light beams. The maximum output power required of one individual radiant energy source is then less. Also, a redundancy is provided should one radiant energy source fail.

A planographic printing press according to the present invention including at least one printing unit has the feature that it has a device according to the present invention for supplying radiant energy. The planographic printing press according to the present invention can be a direct or indirect offset printing press, a flexographic printing press or the like. On one hand, the position at which the light impinges on the printing substrate in the path through the planographic printing press can be downstream of the last printing nip of the last printing unit of the number of printing units, that is, downstream of all printing nips. On the other hand, the position can also be downstream of a first printing nip and upstream of a second printing nip, that is, at least between two printing units.

BRIEF DESCRIPTION OF THE DRAWINGS

Further advantages, advantageous embodiments and refinements of the present invention are described with reference to the following figures, as well as their descriptions. Specifically, they show.

DETAILED DESCRIPTION

Figure 1:
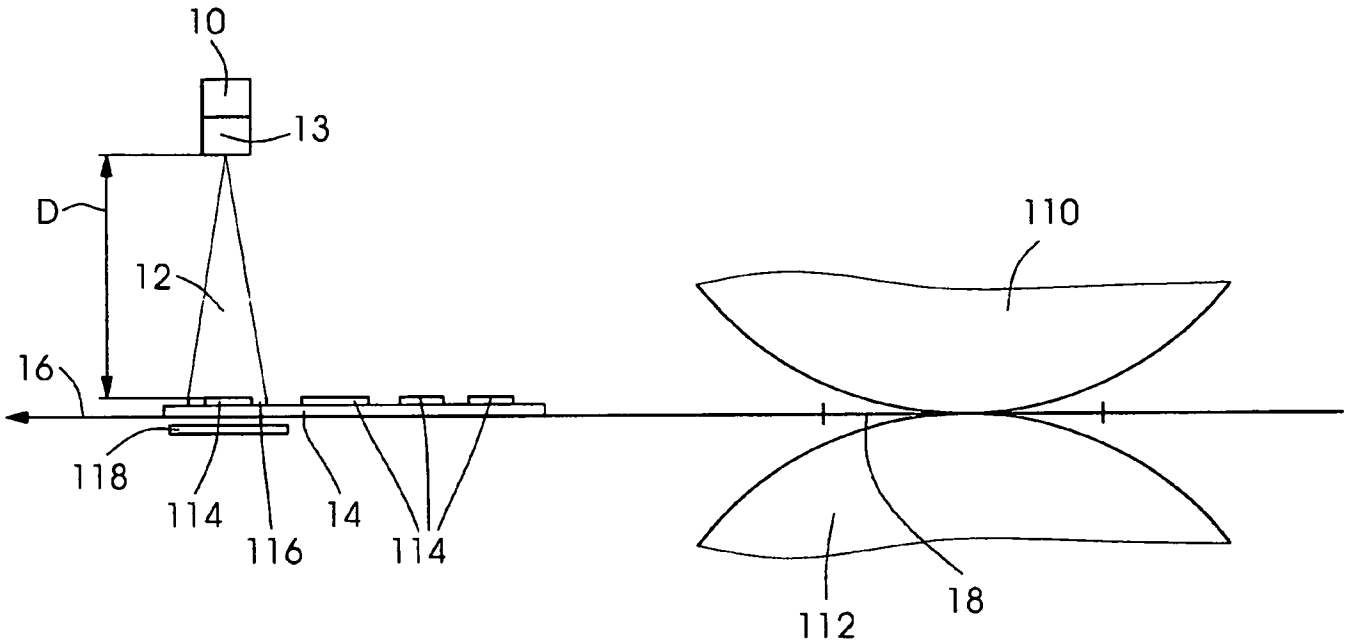
FIG. 1 is a schematic side view to illustrate the arrangement of the device of the present invention.

FIG. 1 shows a schematic side view to illustrate the arrangement of the device of the present invention in a planographic printing press.

A radiant energy source 10, in particular a laser, preferably a diode laser or solid-state laser, is arranged within a planographic printing press in such a manner that light 12 emitted by it impinges on a printing substrate 14 along its path 16 through the planographic printing press at a position 116, which is situated downstream of a printing nip 18.

While in FIG. 1, printing substrate 14 is shown exemplarily in sheet form, the printing substrate can also be passed in web form through the planographic printing press. The orientation of path 16 of printing substrate 14 is indicated by an arrow.

The path shown here is linear, but is not restricted thereto, and may likewise take a generally curve-shaped or non-linear course, in particular a circular arc.

In the embodiment shown in FIG. 1, printing nip 18 is defined by the interaction of printing cylinder 110 and an impression cylinder 112. Depending on the specific printing method employed in the planographic printing press, printing cylinder 110 may be a printing-form cylinder or a blanket cylinder.

On printing substrate 14, there is shown printing ink 114. Light 12 emitted by radiant energy source 10, impinges on printing substrate 14 in the form of a beam or a carpet at a position 116. Printing ink 114 within this position 116 is able to absorb energy from light 12. By advantageously selecting a wavelength that is not resonant to the absorption wavelengths of water, an absorption in printing substrate 14 is reduced.

Distance D of radiant energy source 10 from the surface of printing substrate 14 (exactly: from printing ink 114) is preferably selected to be between about 1 centimeter and about 30 centimeters, more preferably between about 1 centimeter and about 10 centimeters.

Since, in accordance with the present invention, insufficient homogeneity of the light in a direction lateral to the transport direction (that is, in a direction transverse to the direction of the path) of printing substrate 14 may lead to the formation of streaks in the dried printed product, it is advantageous to provide means for ensuring a sufficient homogeneity of the light.

To this end, radiant energy source 10 may be provided with a homogenizing optical system 13 for light 12, the homogenizing optical system ensuring that a line of light (such as a laser line) formed by individual light spots or partial lines of light from a plurality of laterally arranged radiant energy sources 10 is substantially homogeneous in terms of intensity in the direction of the line (laterally to the transport direction of printing substrate 14). This optical system may be part of radiant energy source 10 or be provided separately.

The line of light formed by homogenizing optical system 13 preferably extends laterally to the transport direction of printing substrate 14 over the full width thereof. However, the line of light may also be designed to have a width of about 10 mm to implement modules for building a page-wide illumination bar. Advantageous embodiments produce a focus of 0.01 mm to 10 mm in the transport direction of the printing substrate in order to obtain the advantageous irradiation values [$W/cm^2$] and/or [$mJ/cm^2$] as a function of the printing speed (0.1 m/s-30 m/s). In particular, focus sizes between 0.1 mm and 10 mm or between 1 mm und 5 mm have proven advantageous at printing speeds between 1 m/s und 5 m/s.

Homogenizing optical system 13 may include light-conducting elements of macroscopic or microscopic size. Moreover, homogenizing optical system 13 may contain refractively, diffractively or reflectively functioning optical elements, and combinations of such elements.

The level of homogeneity of light 12 of radiant energy source 10 achieved by homogenizing optical system 13 preferably has a value of less than 15%, and more preferably a value of less than 10% or 5%; the percentages referring to the difference between a lowest and a highest value in the lateral intensity of light 12 (peak-to-valley homogeneity).

Moreover, homogenizing optical system 13 makes it possible to achieve as high a level of homogeneity of light as possible also in the transport direction of printing substrate 14, so that short overheating of the ink can be avoided to the greatest extent possible. The level of homogeneity of light 12 of radiant energy source 10 achieved by homogenizing optical system 13 in the transport direction of printing substrate 14 preferably has a value of less than 30% and more preferably a value of less than 20% or 10%. Here too, the percentages refer to the difference between a lowest and a highest value in the intensity of light 12 in a direction parallel to the transport direction (peak-to-valley homogeneity).

Furthermore, it is advantageous to provide an absorption element 118 on the side of printing substrate 14 opposite radiant energy source 10; the absorption element absorbing radiation that is not absorbed by printing ink 114 or printing substrate 14.

Figure 2:
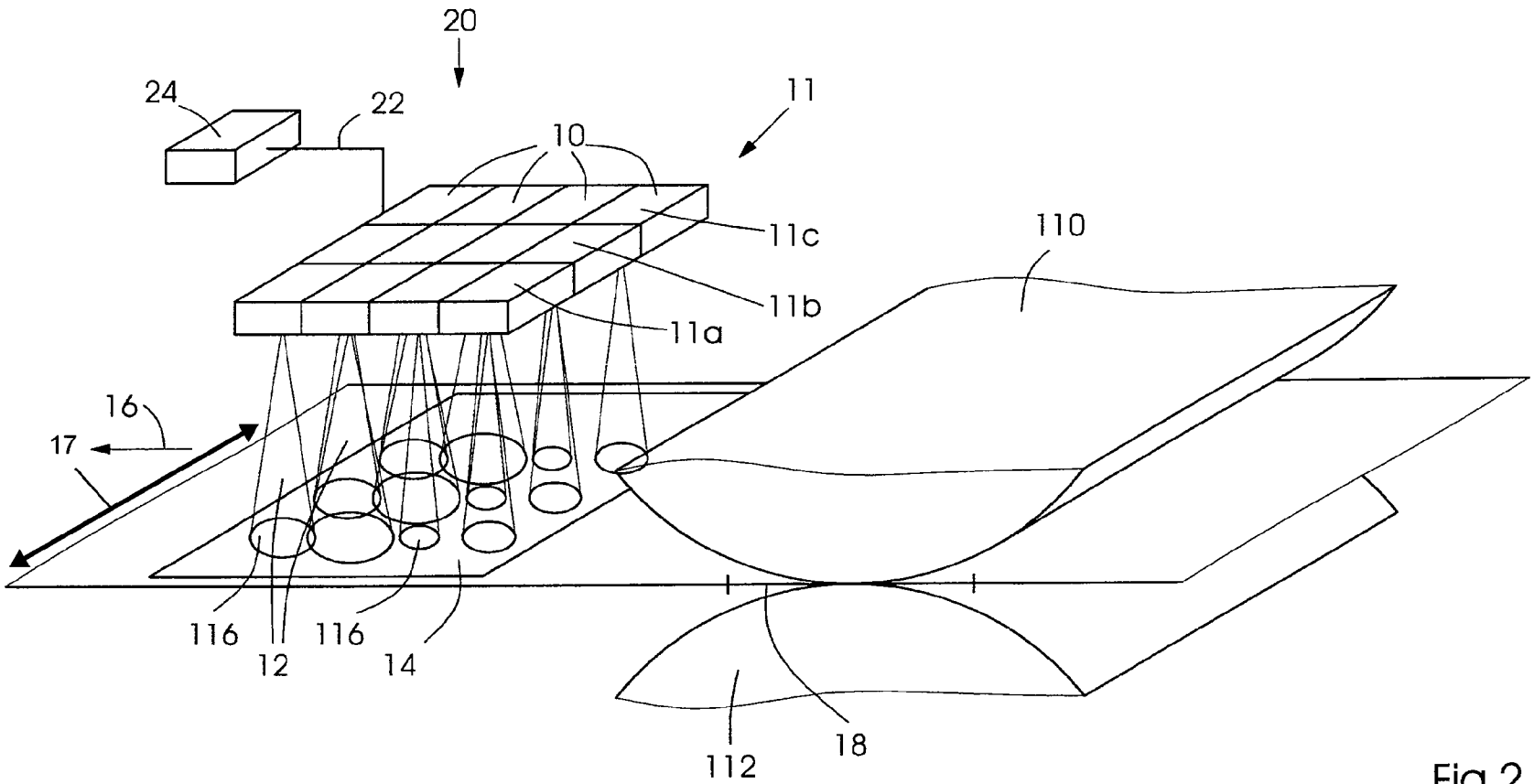
FIG. 2 is a schematic perspective view of an advantageous refinement of the device of the present invention.

FIG. 2 is a schematic representation of an advantageous refinement of the device according to the present invention in a planographic printing press. An array 20 of radiant energy sources 10 is sketched exemplarily, in this case, three times four, thus twelve radiant energy sources 10.

Besides the two-dimensional array 20 shown here, it is also possible to provide a one-dimensional array or a one-dimensional row, oriented across the width of printing substrate 14. Such a row may preferably take the form of a substantially page-wide illumination bar including, for example, a plurality of modules, which in turn include a number of (for example, 10) laser diode bars 11, which in turn include a number of laser diodes 11*a*, 11*b*, 11*c* etc.

Laser diode bars 11 may be arranged both in one line or in several offset lines within the module, thus advantageously allowing for a more compact design.

Because of both the modular design and the arrangement in offset lines, maintenance work to be carried out is made easier for the operator or service personnel.

A laser diode bar 11 preferably has an output power of between about 10 watts and about 200 watts, more preferably of about 50 to 100 watts. Due to the modular design of an illumination bar, this preferably results in a power density of between about 50 and about 500 watts per centimeter.

A two-dimensional array, as also a three-dimensional array, whose light impinges on rapid drying in that a group of positions in one column of array 20 is irradiated in parallel or simultaneously. Consequently, the velocity with which the printing substrate moves past radiant energy sources 10 may be higher than when working with an only one-dimensional array.

By arranging a plurality of rows of radiant energy sources 10 one behind the other, it is also possible, for example, to effectively dry inks containing volatile components (heatset-like inks) by successive evaporation of the components, such as solvents.

Moreover, the radiation from several laser diode bars 11 arranged, for example, adjacent to one another in the direction of the path of the printing substrate may be combined into one beam of light. Preferably, one or more polarization separators may be used for this purpose.

In addition or alternatively, the radiation from several laser diode bars 11 that emit radiation of different wavelengths may be combined by a dichroic light-conducting element.

Array 20 may also have a different number of radiant energy sources 10. Light 12 is supplied to printing substrate 14 from each of the number of radiant energy sources 10. Positions 116, at which light 12 impinges on printing substrate 14 which follows a path 16 through the planographic printing press, are disposed downstream of a printing nip 18, defined by a printing cylinder 110 and an impression cylinder 112.

In this context, individual positions 116 may partially coincide, as shown in FIG. 2 for the front row of radiant energy sources 10, or, essentially, even completely overlap.

Moreover, by selectively overlapping positions 116 in a direction perpendicular (lateral) to the transport direction of printing substrate 14, it is possible to achieve the above-described preferred homogeneity of light 12 in the lateral direction. As discussed above, light 12 is being emitted over a width of substrate 14 in a direction 17 transverse to transport direction 16 so light impinges on printing ink 114 (FIG. 1). Light 12 is emitted so that a difference between a lowest value and a highest value in an intensity of light 12 (peak-to-valley homogeneity) is less than 15% in direction 17 transverse to transport direction 16.

In addition, the overlapping provides a redundancy, ensuring that even if a laser diode fails, the printing ink at the position in question on printing substrate 14 is at least partially dried.

Array 20 of radiant energy sources 10 is associated with a control device 24, with which control signals may be exchanged via a connection 22. Array 20 may be driven by control device 24 in such a way that energy is input in accordance with the quantity of printing ink at position 116 on printing substrate 14.

For example, laser diodes 11*a*, 11*b*, 11*c*, etc., may be switched on and off both individually and together. In addition or alternatively, laser diodes 11*a*, 11*b*, 11*c*, etc., may be varied in power both individually and together. This allows the energy input required at each position of printing substrate 14 for drying to be selectively controlled. Preferably, prepress or print monitoring information about the composition of the print image to be dried (color separations, ink distribution, area coverage, ink thickness) may be used for this purpose.

This allows the printing ink on the printing substrate to be dried with such an accuracy that excessive heating and, thus, excessive evaporation of the printing ink, especially with lateral variations, can be avoided. The input of radiant energy can be controlled to an accuracy of 10%, more preferably 5%, or even only 1%.

Figure 3:
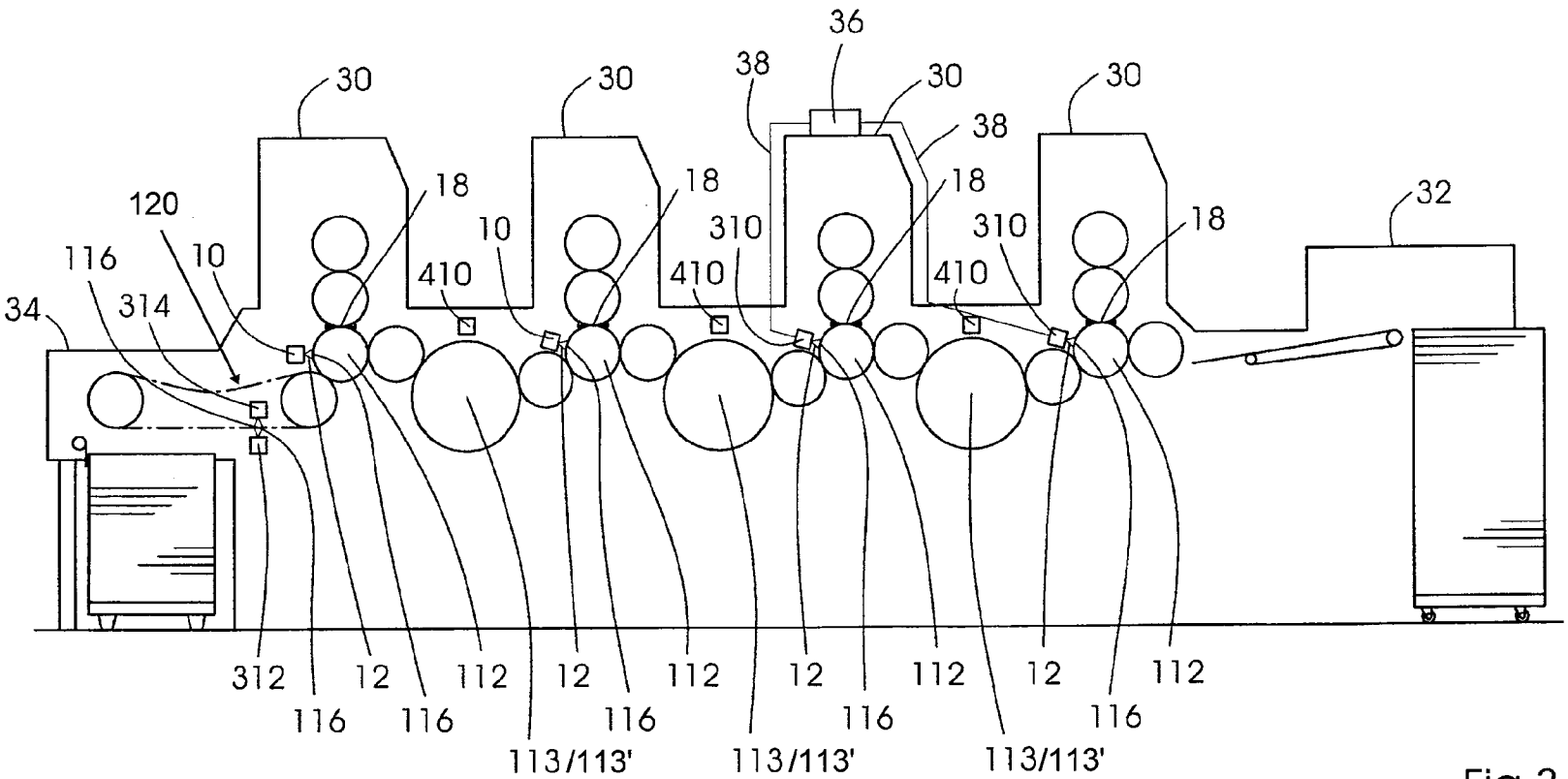
FIG. 3 is a schematic side view of a planographic printing press featuring diverse alternative arrangements of the inventive device on the printing units or downstream of the last printing unit.

FIG. 3 shows a schematic representation of a planographic printing press, in this specific embodiment, a sheet-fed offset press, featuring diverse alternative arrangements of the inventive device on the printing units or downstream of the last printing unit.

By way of example, the planographic printing press has four printing units 30, a feeder 32, and a delivery 34. Within the planographic printing press, various cylinders are shown, which, on the one hand, are used for passing the sheets through the machine and, on the other hand, provide a planographic printing surface, whether it be directly as a printing-form cylinder or as a transfer cylinder, in particular a blanket cylinder.

Typical printing units 30 in planographic printing presses also include an inking system and, optionally, a dampening system. Each printing unit 30 includes a printing cylinder 110 and an impression cylinder 112 which define a printing nip 18.

At first and second printing units 30, there is shown a central radiant energy source 36 from where light is guided via light-conducting elements 38, for example, optical waveguides, mirrors, imaging optics and the like, to projection elements 310 which are allocated to printing units 30. Projection elements 310 emit light 12 onto the path 16 of printing substrate 14 through the planographic printing press at positions 116 which are preferably downstream of the respective printing nips 18 of allocated printing units 30. By using light-conducting elements 38, it is possible to position radiant energy source 36 at a suitable location within the planographic printing press where sufficient space is available.

At third and fourth printing units 30, there are shown radiant energy sources 10 from where light 12 is supplied onto path 16 of printing substrate 14 directly at positions 116 which are downstream of printing nip 18 of the respective printing unit 30.

Moreover, an alternative radiant energy source 312 and a further alternative radiant energy source 314 are shown within delivery 34.

Analogous to the arrangements shown in FIG. 3 by way of a sheet-fed printing press, devices according to the present invention for supplying radiant energy can also be advantageously used in a web-fed printing press, in particular in so-called "web-fed rotary presses", whether it be for job printing or newspaper printing.

The installation location of a radiant energy source 10, such as a substantially page-wide laser diode illumination bar, within the printing press is preferably selected at a position where only little or substantially no movement of printing substrate 14 is possible in the propagation direction of the radiation (of light 12), that is, for example, at a position where printing substrate 14 moves in a substantially flutter-free manner.

In this manner, a high accuracy may be provided in terms of the irradiation dose, because it can be ensured that printing substrate 14 is always located at the focus, that is, at the focal distance of radiant energy source 10. Variations in the drying process, which may become visible in the dried product, can thereby be effectively prevented.

For this reason, preference is given to installation locations 10 and/or 310 opposite of an impression cylinder 112, but also installation locations 410 opposite of a reversing drum 113 or a transfer cylinder 113' provided in place of the reversing drum. In these cases, printing substrate 14, which may be a paper sheet, is carried by the respective cylinder or the respective drum and therefore moves in a stable and substantially flutter-free manner.

Also preferred is an installation place near or closely adjacent to a suction-belt conveyor device 120, such as in a dryer or delivery downstream of a printing unit.

Moreover, the focus of radiant energy source 10 is advantageously selected to have a large depth of focus such that slight movements of printing substrate 14 perpendicular to the transport direction of printing substrate 14 still take place within the depth of focus range and are therefore unproblematic.

Within a depth of focus of the optical system of about 3 mm (but at least of 1 mm), the power density should not vary more than 15% and/or the focus size should not change more than 15%, preferably not more than 10% or 5%.

In addition or alternatively, the focus may be selected to be adjustable in a direction perpendicular to the transport direction of printing substrate 14. In this manner, the irradiation dose may, on the one hand, be changed by the focus control, if desired or beneficial, and, on the other hand, be maintained constant by the focus control for different printing speeds, that is, for different transport paths of the printing substrate, caused, for example, by centrifugal forces.

In one embodiment of the method according to the present invention for supplying radiant energy of a wavelength in the near infrared onto a printing substrate, an infrared-absorbing agent is used which is suitable because of the position of its absorption maximum or maxima in the so-called "window" of the absorption spectrum of paper, in particular, in the so-called "window" of the absorption spectrum of water.

A required quantity of infrared-absorbing agent is added to the printing ink as an additive or admixture. This can be accomplished, for example, by stirring the printing ink together with the infrared-absorbing agent outside or inside the planographic printing press. An addition of infrared-absorbing agent is generally only useful for the so-called "chromatic colors", in particular, for four-color offset printing for the colors yellow, magenta and cyan (Y, M and C).

An addition for the contrasting color, in four-color offset printing for the color black (K), is generally not necessary since, as a rule, black printing ink has sufficient absorption in the entire relevant and mentioned wavelength range between 700 nm and 2500 nm. However, an addition is nevertheless possible.

The required quantity of infrared-absorbing agent is calculated in a first approximation according to the Lambert-Beer extinction law, the layer thickness of the printing ink on the printing substrate and the extinction coefficient. In this representation, the calculations according to the Lambert-Beer extinction law are based on direct resonance, that is, the emission wavelength is in the immediate vicinity of the absorption maximum. In the case of slightly different laser wavelengths, a likewise slightly different absorption is obtained, requiring a correspondingly, preferably proportionally greater amount of infrared-absorbing agent. For the sake of completeness, it should be mentioned that these considerations do not yet take into account light-scattering and saturation effects, which are relevant in practice.

For irradiation of the printing substrate, a radiant energy source is used whose light is essentially resonant to the absorption maximum of the infrared-absorbing agent. In this embodiment, it is possible to carry out the printing process in the planographic printing press without further measures and without deviating from the conventional printing method.

It may be advantageous not to irradiate the printed sheet perpendicularly, but at a smaller angle (as measured with respect to the surface). In any case, an extended absorption path is advantageous here. Possibly, a specific angle may also be advantageous in order to minimize reflectance.

In a first exemplary embodiment of the method according to the present invention, the infrared-absorbing agent used is 3-butyl-2(2-[-2-(3-butyl-1,1-dimethyl-1,3-dihydro-benzo[e]indol-2-ylidene)ethylidene]-2-chloro-cyclohex-1-enyl]-ethenyl)-1,1-dimethyl-1H-benzo[e]indolium perchlorate having the empirical formula $C_{46}H_{52}Cl_2N_2O_4$ and a molecular weight of 767.84 g $mol^{-1}$. This infrared-absorbing agent has an absorption maximum at 819 nm and a maximum extinction of $$267214\left[\frac{\text{Liter}}{\text{mol}\times\text{cm}}\right].$$

For a laser light absorption of approximately 90%, 1.4 percent by weight of the infrared-absorbing agent is required as an additive in the colors C, M and Y for a layer thickness of 2 μm (according to the Lambert-Beer extinction law). (In comparison: 0.9 percent by weight for approximately 75%, 0.4 percent by weight for approximately 50%, and 0.2 percent by weight for approximately 30%).

The device for supplying radiant energy includes, as the radiant energy source, a laser which emits at 808 nm; for example, an InGa(AI)As Quantum Well Laser of the MB series from DILAS Diodenlaser GmbH of Mainz, Germany can be used. The mentioned laser from DILAS has a maximum optical output power of 24 W. The beam geometry downstream of the collimator is 4 mm×12 mm. Thus, the emission wavelength is sufficiently resonant to the absorption maximum of 819±15 nm; the infrared-absorbing agent shows an absorption greater than 50%. In this exemplary embodiment, a beam profile and an irradiation time of 2 ms for an energy per area of 100 mJ/$cm^2$ have been selected, the printing speed being 2 m/s (which corresponds to 14400 prints per hour for a sheet length of 50 cm). The absorption of radiation by water vapor in the air is below 0.5%.

In a second exemplary embodiment of the method according to the present invention, the infrared-absorbing agent used is 2[2-[2chloro-3-[2-(3-ethyl-1,3-dihydro-1,1-dimethyl-2H-benzo[e]indol-2-ylidene)-ethylidene]-1cyclohexen-1-yl]-ethenyl]3-ethyl-1,1 dimethyl-1H-benzo[e]indolium tetraflouroborate having the empirical formula $C_{42}H_{44}BClF_4N_2$ and a molecular weight of 699.084 g $mol^{-1}$. This infrared-absorbing agent has an absorption maximum at 816 nm and a maximum extinction of $$390307\left[\frac{\text{Liter}}{\text{mol}\times\text{cm}}\right].$$

For a laser light absorption of 90%, 0.9 percent by weight of the infrared-absorbing agent is required as an additive in the colors C, M and Y for a layer thickness of 2 μm (according to the Lambert-Beer extinction law). (In comparison: 0.5 percent by weight for approximately 75%, 0.3 percent by weight for approximately 50%, and 0.1 percent by weight for approximately 30%).

The device for supplying radiant energy includes, as the radiant energy source, a laser which emits at 808 nm; for example, a HLU 100*c*, 10×12 diode laser from LIMO—Lissotschenko Mikrooptik GmbH of Dortmund, Germany can be used. The mentioned laser from LIMO has a maximum optical output power of 100 W. The beam geometry downstream of the collimator is 10 mm×12 mm. Thus, the emission wavelength is sufficiently resonant to the absorption maximum of 816±15 nm; the infrared-absorbing agent shows an absorption greater than 50%. In this exemplary embodiment, a beam profile and an irradiation time of 40 ms for an energy per area of 833 mJ/cm have been selected, the printing speed being 0.5 m/s (which corresponds to 3600 prints per hour for a sheet length of 50 cm). The absorption of radiation by water vapor in the air is below 0.5%.

In a third exemplary embodiment of the method according to the present invention, the infrared-absorbing agent used is benzenaminium-N,N'-2,5-cyclohexadiene-1,4-diylidenebis [4-(dibutylamino)-N-[4-(dibutylamino)phenyl] diperchlorate having the empirical formula $C_{62}H_{92}Cl_2N_6O_8$ and a molecular weight of 1120.37 g $mol^{-1}$. This infrared-absorbing agent has an absorption maximum at 1064 nm and a maximum extinction of $$81300\left[\frac{\text{Liter}}{\text{mol}\times\text{cm}}\right].$$

For a laser light absorption of approximately 50%, 4.8 percent by weight of the infrared-absorbing agent is required as an additive in the colors C, M and Y for a layer thickness of 2 m (according to the Lambert-Beer extinction law). (In comparison: 15.9 percent by weight for approximately 90%, 9.6 percent by weight for approximately 75%, and 2.5 percent by weight for approximately 30%).

The device for supplying radiant energy includes, as the radiant energy source, a laser which emits at 1075 nm; for example, a YLR-100 ytterbium fiber laser from IPG Photonics Corporation of Oxford, Massachusetts can be used. The mentioned laser from IPG Photonics has a maximum optical output power of 100 W. The beam geometry in the focal plane can be 3 mm x 3 mm. Thus, the emission wavelength is sufficiently resonant to the absorption maximum of 1064±15 nm; the infrared-absorbing agent shows an absorption greater than 50%. In this exemplary embodiment, a beam profile and an irradiation time of 5 ms and an energy per area of 417 $mJ/cm^2$ have been selected, the printing speed being 2 m/s (which corresponds to 14400 prints per hour, for a sheet length of 50 cm). The absorption of radiation by water vapor in the air is below 0.1%.

In a fourth exemplary embodiment of the method according to the present invention, the infrared-absorbing agent used is Bis(3,4-dimethoxy-2-chlorodithiobenzil)nickel having the empirical formula $C_{32}H_{26}Cl_2NiO_4S_4$ and a molecular weight of 732.4 g $mol^{-1}$. This infrared-absorbing agent has an absorption maximum at 885 nm and a maximum extinction of 16000

$$\left[\frac{\text{Liter}}{\text{mol}\times\text{cm}}\right].$$

For a laser light absorption of approximately 75%, 3.2 percent by weight of the infrared-absorbing agent is required as an additive in the colors C, M and Y for a layer thickness of 2 μm (according to the Lambert-Beer extinction law). (In comparison: 5.3 percent by weight for approximately 90%, 1.6 percent by weight for approximately 50%, and 0.8 percent by weight for approximately 30%).

The device for supplying radiant energy includes, as the radiant energy source, a laser which emits at 870 nm; for example, a DLDFC-50 fiber-coupled laser diode system from Laser2000 GmbH of Munich, Germany can be used. The mentioned laser from Laser2000 has a maximum optical output power of 50 W and can be used in CW or pulsed mode operation. Thus, the emission wavelength is sufficiently resonant to the absorption maximum of 885±15 nm; the infrared-absorbing agent shows an absorption greater than 50%. In this exemplary embodiment, a beam profile and an irradiation time of 5 ms for an energy per area of 152 $mJ/cm^2$ have been selected, the printing speed being 2 m/s (which corresponds to 14400 prints per hour for a sheet length of 50 cm). The absorption of radiation by water vapor in the air is below 0.1%.

The homogeneity, focus size and and power density percentages used herein may be approximate values, so that, for example, 15% may mean about 15%.

List of Reference Symbols

10 radiant energy source/installation location of the radiant energy source
11 laser diode bar
11*a* laser diode
11*b* laser diode
11*c* laser diode
12 light
13 homogenizing optical system
14 printing substrate
16 path of the printing substrate
18 printing nip
110 printing cylinder
112 impression cylinder
113 reversing drum
114 printing ink
116 position on the printing substrate
118 absorption element
20 array of radiant energy sources
22 connection for the transmission of control signals
24 control unit
30 printing unit
32 feeder
34 delivery
36 central radiant energy source
38 light-conducting element
310 projection element/installation location of the projection element
312 alternative radiant energy source

314 further alternative radiant energy source

410 radiant energy source/installation location of the radiant energy source D distance

What is claimed is:

1. A device for supplying radiant energy onto a printing substrate traveling in path through a printing press in a transport direction, the printing press including a printing unit and at least one printing nip in the printing unit, the printing substrate including inked portion, the device comprising:

at least one radiant energy source emitting light on the printing substrate traveling in the path through the printing press in the transport direction downstream from the at least one printing nip in the printing unit, the light being emitted over a width of the inked portion of the printing substrate in a direction transverse to the transport direction so that a difference between a lowest value and a highest value in an intensity of the light is less than 15% in the direction transverse to the transport direction; and an optical system ensuring that the light emitted by the at least one energy source is substantially homogenous;

wherein within a depth of focus of about 1 to 3 mm of the optical system, a power density does not vary more than 15%;

wherein the light impinges on the printing substrate at a position in the path through the printing press and the position is selected such that at the position, the printing substrate moves in a substantially flutter-free manner with respect to a propagation direction of the light so the printing substrate is maintained at a focal distance of the at least one radiant energy source.

2. The device for supplying radiant energy as recited in claim 1 wherein as the light impinges upon the printing substrate the difference between a lowest value and a highest value in an intensity of the light is less than 10% in the direction transverse to the transport direction.

3. The device for supplying radiant energy as recited in claim 1 wherein as the light impinges upon the printing substrate the difference between a lowest value and a highest value in an intensity of the light is less than 5% in the direction transverse to the transport direction.

4. The device for supplying radiant energy as recited in claim 1 wherein the at least one radiant energy source includes at least one laser.

5. The device for supplying radiant energy as recited in claim 4 wherein the laser is a semiconductor laser or a solid-state laser.

6. The device for supplying radiant energy as recited in claim 1 wherein the at least one radiant energy source has a plurality of radiant energy sources arranged in a one-dimensional array or a two-dimensional array, the light impinging on the printing substrate at a number of positions.

7. The device for supplying radiant energy as recited in claim 1 further comprising a control unit, the at least one radiant energy source including a plurality of radiant energy sources, the control unit controlling the intensity and an exposure time for each of the plurality of radiant energy sources independently of the other radiant energy sources of the plurality of energy sources.

8. The device for supplying radiant energy as recited in claim 1 wherein the printing unit includes an impression cylinder, a reversing drum, a transfer cylinder and a suction-belt conveyor device and the position is selected to be next to the impression cylinder, next to the reversing drum, next to the transfer cylinder or next to the suction-belt conveyor device.

9. The device for supplying radiant energy as recited in claim 1 wherein within a depth of focus of about 1 to 3 mm of the optical system the power density does not vary more than 10%.

10. The device for supplying radiant energy as recited in claim 9 wherein within a depth of focus of about 1 to 3 mm of the optical system, the power density does not vary more than 5%.

11. The device for supplying radiant energy as recited in claim 1 further comprising an optical system ensuring that the light emitted by the at least one energy source is substantially homogenous, wherein within a depth of focus of about 1 to 3 mm of the optical system, the focus size does not change more than 15%.

12. The device for supplying radiant energy as recited in claim 11 wherein within a depth of focus of about 1 to 3 mm of the optical system, the focus size does not change more than 10%.

13. The device for supplying radiant energy as recited in claim 11 wherein within a depth of focus of about 1 to 3 mm of the optical system, the focus size does not change more than 5%.

14. A planographic printing press comprising:

at least one printing unit having a device for supplying radiant energy according to claim 1.

15. A device for supplying radiant energy onto a printing substrate traveling in path through a printing press in a transport direction, the printing press including a printing unit and at least one printing nip in the printing unit, the printing substrate including inked portion, the device comprising:

at least one radiant energy source emitting light on the printing substrate traveling in the path through the printing press in the transport direction downstream from the at least one printing nip in the printing unit, the light being emitted over a width of the inked portion of the printing substrate in a direction transverse to the transport direction so that a difference between a lowest value and a highest value in an intensity of the light is less than 15% in the direction transverse to the transport direction; and an optical system ensuring that the light emitted by the at least one energy source is substantially homogenous;

wherein within a depth of focus of about 1 to 3 mm of the optical system, the focus size does not change more than 15%;

wherein the light impinges on the printing substrate at a position in the path through the printing press and the position is selected such that at the position, the printing substrate moves in a substantially flutter-free manner with respect to a propagation direction of the light so the printing substrate is maintained at a focal distance of the at least one radiant energy source.

16. A planographic printing press comprising:

at least one printing unit having a device for supplying radiant energy according to claim 15.

* * * * *